US009099779B2

(12) United States Patent
Chang et al.

(10) Patent No.: US 9,099,779 B2
(45) Date of Patent: Aug. 4, 2015

(54) ANTENNA ASSEMBLY AND WIRELESS COMMUNICATION DEVICE EMPLOYING SAME

(71) Applicants: Tze-Hsuan Chang, New Taipei (TW); Cho-Kang Hsu, New Taipei (TW)

(72) Inventors: Tze-Hsuan Chang, New Taipei (TW); Cho-Kang Hsu, New Taipei (TW)

(73) Assignee: Chi Mei Communications Systems, Inc., New Taipei (TW)

( * ) Notice: Subject to any disclaimer, the term of this patent is extended or adjusted under 35 U.S.C. 154(b) by 220 days.

(21) Appl. No.: 13/663,507

(22) Filed: Oct. 30, 2012

(65) Prior Publication Data

US 2013/0335277 A1 Dec. 19, 2013

(30) Foreign Application Priority Data

Jun. 15, 2012 (TW) ..... 101121518 A

(51) Int. Cl.

| | |
|---|---|
| ***H01Q 5/00*** | (2006.01) |
| ***H01Q 1/24*** | (2006.01) |
| ***H01Q 9/42*** | (2006.01) |
| ***H01Q 5/378*** | (2015.01) |

(52) U.S. Cl.
CPC ..... *H01Q 5/378* (2015.01); *H01Q 1/243* (2013.01); *H01Q 9/42* (2013.01)

(58) Field of Classification Search
CPC ..... H01Q 1/243; H01Q 5/378; H01Q 9/065
USPC ..... 343/700 MS, 702
See application file for complete search history.

(56) References Cited

U.S. PATENT DOCUMENTS

| | | | | |
|---|---|---|---|---|
| 2006/0197709 | A1* | 9/2006 | Tung | 343/702 |
| 2006/0232484 | A1* | 10/2006 | Wulff et al. | 343/702 |
| 2008/0150811 | A1* | 6/2008 | Honda et al. | 343/702 |
| 2011/0128190 | A1* | 6/2011 | Galeev | 343/702 |
| 2012/0306709 | A1* | 12/2012 | Wu et al. | 343/767 |

* cited by examiner

*Primary Examiner* — Robert Karacsony
*Assistant Examiner* — Daniel J Munoz
(74) *Attorney, Agent, or Firm* — Novak Druce Connolly Bove + Quigg LLP

(57) ABSTRACT

An antenna assembly employed by a wireless communication device having a housing includes a base board, a grounding member secured on the base board and grounding the antenna assembly, a first radio member electrically connected to the based board to receive and transmit wireless signals having a first central frequency, and a second radio member forming a portion of the housing and electrically connected to the grounding member. The second radio member couples with the first radio member to receive and transmit wireless signals having a second central frequency.

13 Claims, 4 Drawing Sheets

ANTENNA ASSEMBLY AND WIRELESS COMMUNICATION DEVICE EMPLOYING SAME

BACKGROUND

1. Technical Field

The present disclosure relates to antenna assemblies and wireless communication devices employing the antenna assemblies.

2. Description of Related Art

Antennas are important elements of wireless communication devices, such as mobile phones. A wireless communication device may receive/transmit wireless signals having different frequencies, which requires an antenna of the wireless communication device be a multiband antenna. However, many multiband antennas have complicated structures and are large in size, making it difficult to miniaturize portable electronic devices.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
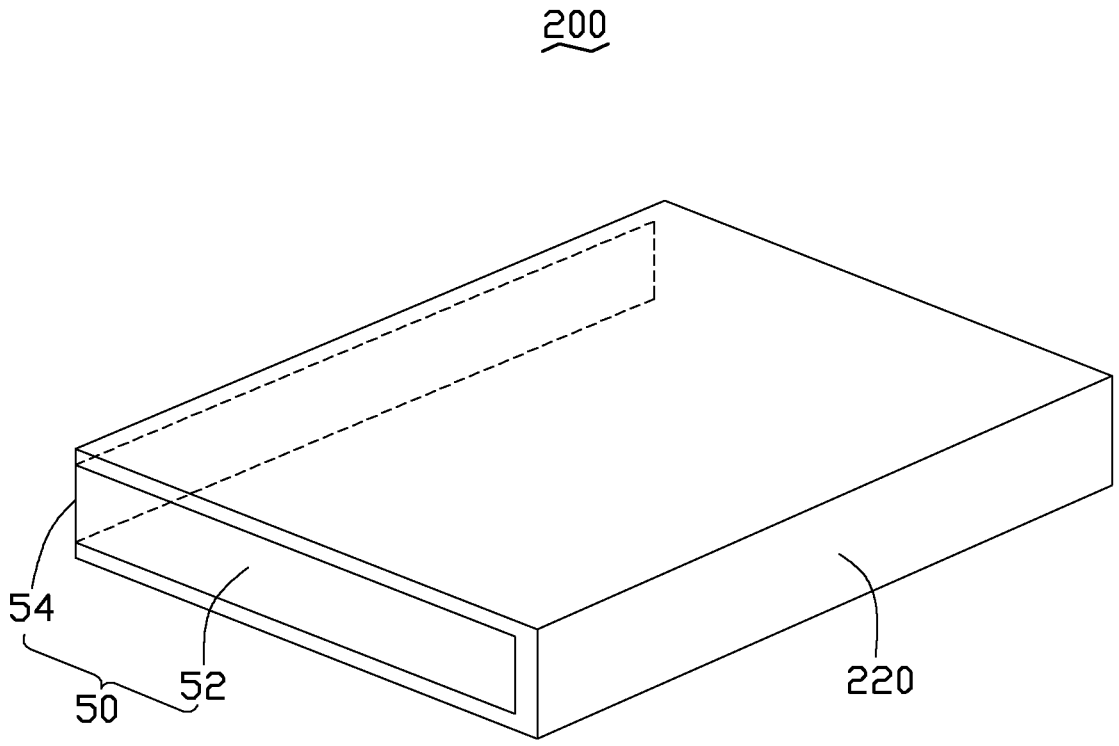
FIG. 1 is a partial schematic view of a wireless communication device employing an antenna assembly in accordance with an exemplary embodiment.
Figure 2:
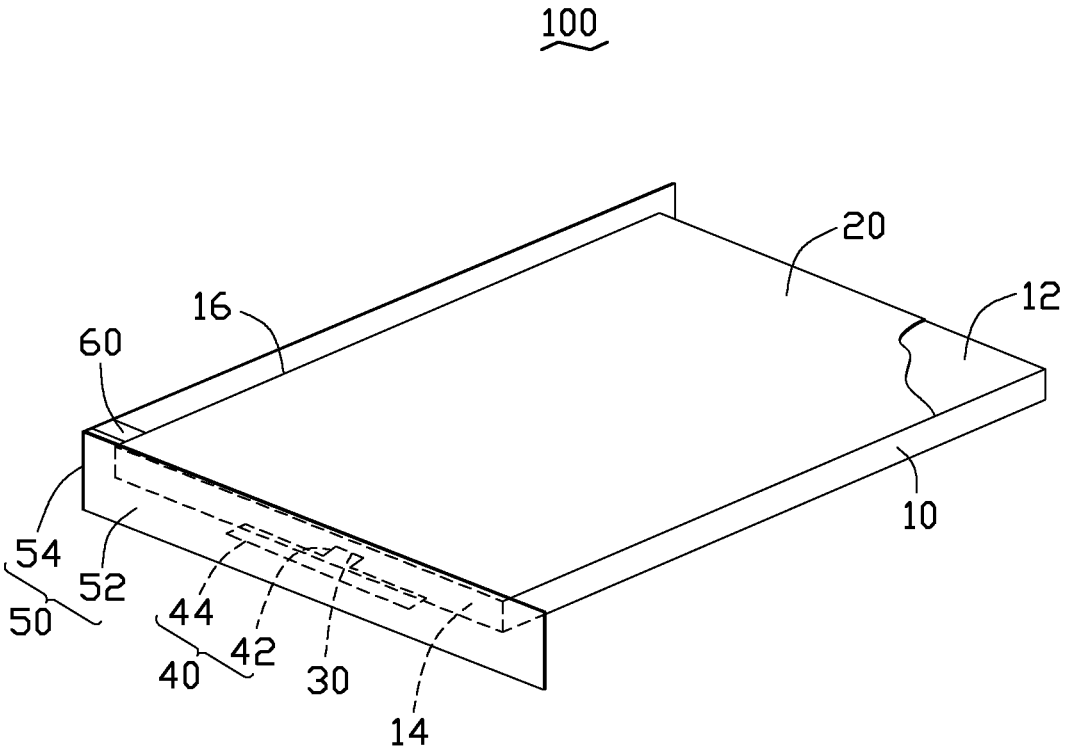
FIG. 2 is a schematic view of an antenna assembly.

FIG. 1 and FIG. 2 show an exemplary embodiment of a wireless communication device 200 employing an antenna assembly 100. The wireless communication device 200 may be a mobile phone or a personal digital assistant for example. The wireless communication device 200 includes a housing 220 made of a non-conductive material, such as plastic. The housing 220 defines a receiving space (not labeled) receiving the antenna assembly 100.

The antenna assembly 100 includes a base board 10, a grounding member 20, a feed point 30, a first radio member 40, a second radio member 50, and a connecting member 60.

In the exemplary embodiment, the base board 10 is a printed circuit board (PCB) of the wireless communication device 200 made of composite material composed of woven fiberglass cloth with an epoxy resin binder. The base board 10 is substantially a rectangular board having a top surface 12, a first side surface 14, and a second side surface 16. The first and second surfaces 14, 16 are perpendicular to each other and the first and second surfaces 14, 16 are both perpendicular to the top surface 12.

The grounding member 20 is positioned on the top surface 12 grounding the antenna assembly 100. In the exemplary embodiment, the grounding member 20 is a copper layer plated on the top surface 12.

The feed point 30 is positioned on the first side surface 14 of the base board 10. The feed point 30 feeds current into the first radio member 40.

Figure 3:
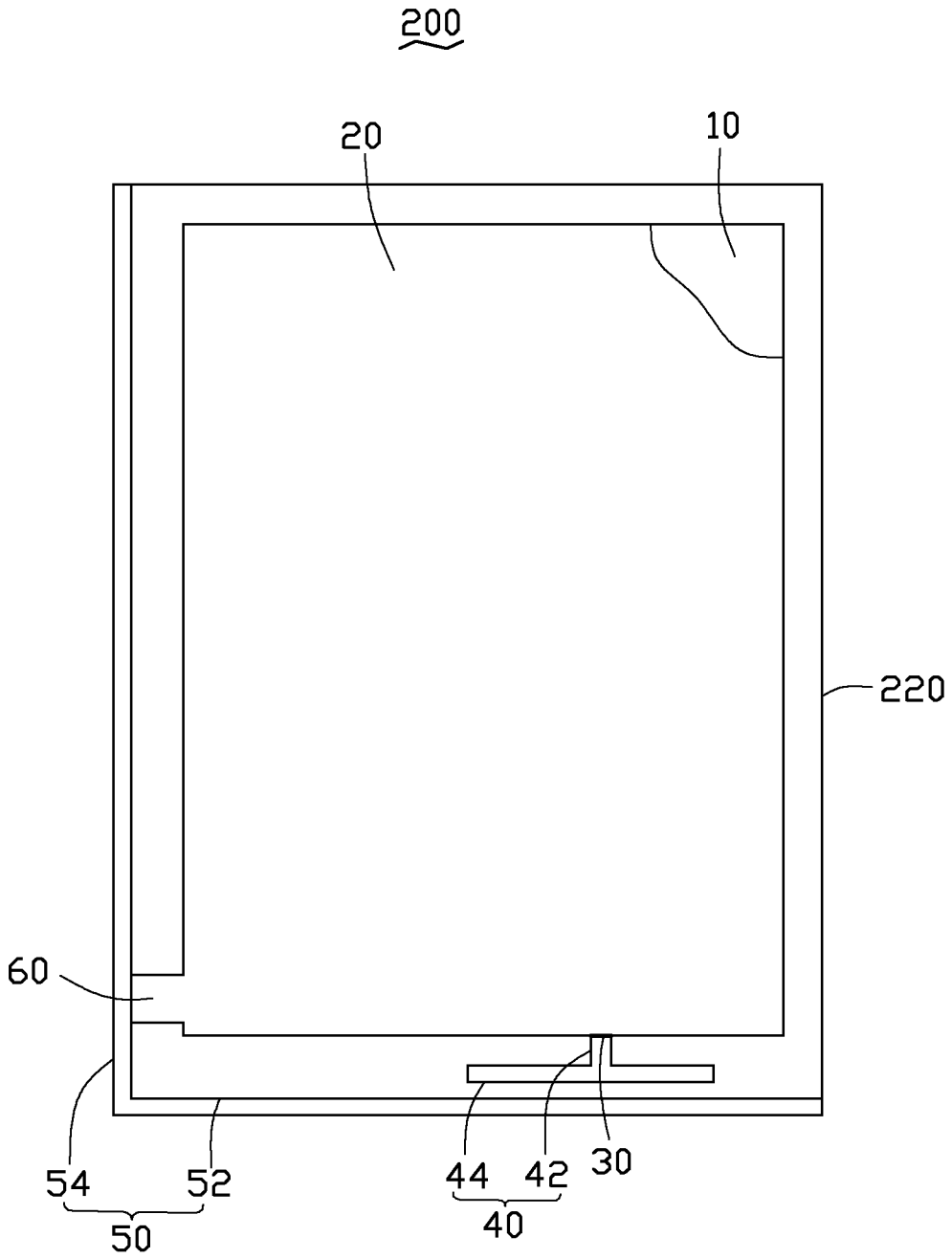
FIG. 3 is a plan view of the wireless communication device shown in FIG. 1.

Referring to FIGS. 1-3, in the exemplary embodiment, the first radio member 40 is a monopole antenna made from iron or flexible printed circuit. The first radio member 40 is secured on the first side surface 14 and electrically connected to the feed point 30 through a strip line or a leaf spring or the like. The first radio member 40 can obtain current from the base board 10 and can be used to receive and transmit wireless signals having a first central frequency. In the exemplary embodiment, the first radio member 40 is substantially T-shaped sheet including a first portion 42 and a second portion 44. An end of the first portion 42 is connected with the feed point 30. The first portion 42 is perpendicular to the first side surface 14. Another end of the first portion 42 connects with the second portion 44. The second portion 44 is coplanar with the first portion 42 and extends perpendicular along the first side surface 14. The first radio member 40 can be used to receive and transmit wireless signals having a first central frequency of about 1710-2170 MHz (such as GSM 1800/1900 or WCDMA 2100).

The second radio member 50 is made of metal and is secured on the housing 220. The second radio member 50 can be a metal sheet partially wrapping an outer surface of the housing 220. Alternatively, the second radio member 50 can be a metal member inlayed in the housing 220. In another word, the second radio member 50 can be a metal portion of the housing 220. In the exemplary embodiment, the second radio member 50 includes a first section 52 and a second section 54 connecting with the first section 52. The first section 52 is a planar sheet parallel to the first side surface 14 and spaced from the section portion 44 of the first radio member 40. The second section 54 is a planar sheet parallel to and spaced from the second side surface 16. The first radio member 40 can couple with the second radio member 50 to receive and transmit wireless signals having a second central frequency by adjusting the shape of the first and second radio members 40, 50 and the distance between the first and second radio members 40, 50. For example, the first radio member 40 coupling with the second radio member 50 can be used to effectively receive and transmit wireless signals having a second central frequency of about 824-960 MHz (such as GSM 850/900 or WCDMA Band 5/8).

The connecting member 60 is a metal sheet and is electrically connected to the grounding member 20 and the second radio member 50 by soldering, for example. In the exemplary embodiment, an end of the connecting member 60 connects with a portion of the grounding member 20 near the second side surface 16. Another end of the connecting member 60 connects with the second section 54. The second central frequency of the wireless signals received and transmitted by the first radio member 40 coupling with the second radio member 50 can be adjusted by adjusting the connecting positions of the grounding member 20 and the second radio member 50 where the connecting member 60 connects. For example, if the connecting member 60 connects portions of the grounding member 20 and the second radio member 50 near the feed point 30, the first radio member 40 coupling with the second radio member 50 can receive and transmit wireless signals having a relative high second central frequency. On the contrary, if the connecting member 60 connects portions of the grounding member 20 and the second radio member 50 away from the feed point 30, the first radio member 40 coupling with the second radio member 50 can receive and transmit wireless signals having a relative low second central frequency.

In other embodiments, the first radio member 40 can have other shapes, such as an L-shape, an F-shape, or an S-shape.

In other embodiments, the first radio member 40 can be structured to be another type antenna, such as a PIFA antenna.

In other embodiments, the second radio member 50 may be any other unclosed structure. For example, the second radio member 50 may further include a third section (not shown) connecting with an end of the second section 54 away from the first section 52. The third section may be parallel to the first section 52.

Figure 4:
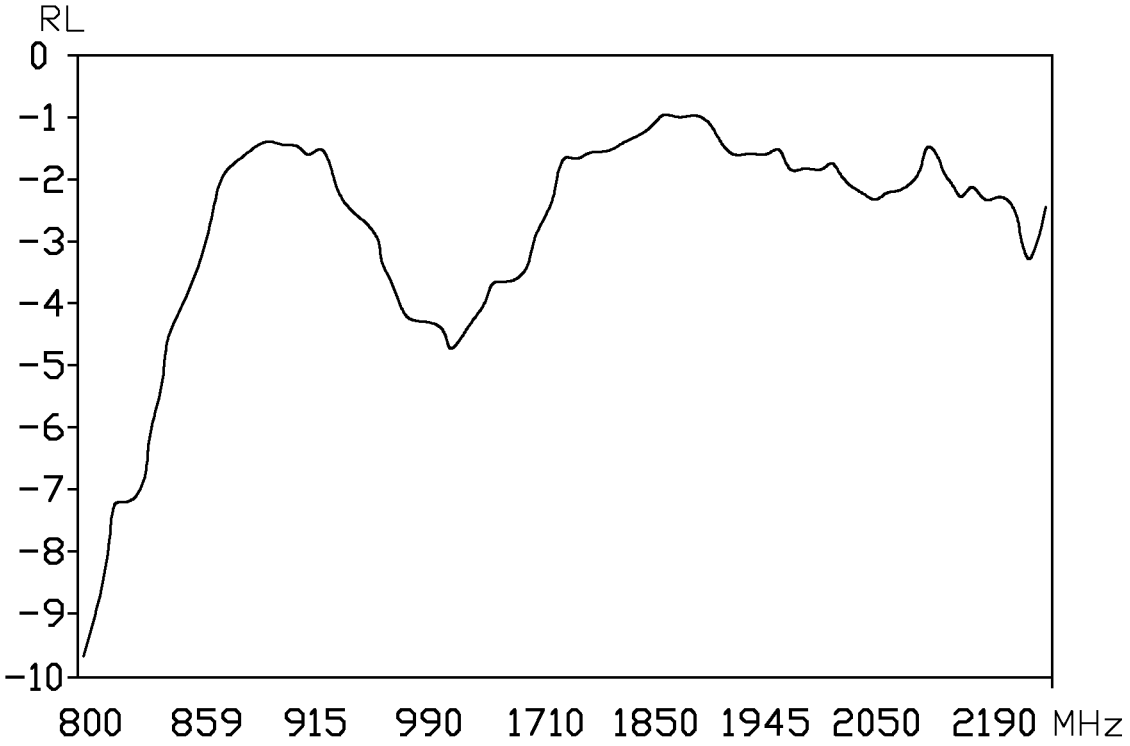
FIG. 4 is a return loss (RL) graph of the antenna assembly shown in FIG. 2, in two different working frequency bands.

In principal, the first radio member 52 obtains electric current from the feed point 30 and the first radio member 52 receives and transmits the wireless signals having the first central frequency. The second radio member 54 induces the electric current in the first radio member 52 and couples with the first radio member 52 to receive and transmit the wireless signals having the second central frequency. FIG. 4 shows that when the antenna assembly 100 is used to receive and transmit wireless communication signals in central frequencies of 1710-2170 MHz and 824-960 MHz, the antenna assembly 100 has wide bandwidths.

The antenna assembly 100 uses the first radio member 52 to receive and transmit wireless signals having the first central frequency and uses the first and second radio member 52, 54 cooperatively to receive and transmit wireless signals having the second central frequency. Thus, the antenna assembly 100 can receive and transmit dual-band wireless signals. Moreover, the second radio member 54 is secured on the housing 220, aiding in miniaturization of the wireless communication device 200 employing the antenna assembly 100.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A wireless communication device, comprising:

a housing; and an antenna assembly received in the housing, the antenna assembly comprising:

a base board comprising a first side surface and a second side surface perpendicular to the first side surface;

a grounding member secured on the base board and grounding the antenna assembly;

a first radio member electrically connected to the base board to receive and transmit wireless signals having a first central frequency, the first radio member comprising a first portion and a second portion coplanar with the first portion, the first portion perpendicular to the first side surface, an end of the first portion connected to the first side surface, another end connected with the second portion, the second portion extending parallel along the first side surface; and a second radio member secured on the housing and electrically connected to the grounding member, the second radio member coupling with the first radio member to receive and transmit wireless signals having a second central frequency, the second radio member comprising a first section and a second section connecting with the first section, the first section parallel to the first side wall and spaced from the second portion, the second section parallel to and spaced from the second side surface.

2. The wireless communication device as claimed in claim 1, wherein the second radio member is a metal sheet partially wrapping the housing.

3. The wireless communication device as claimed in claim 1, wherein the second radio member is a metal member inlayed in the housing.

4. The wireless communication device as claimed in claim 1, further comprising a feed point positioned on the base board, wherein the feed point electrically connects with the first radio member for feeding current into the first radio member.

5. The wireless communication device as claimed in claim 1, wherein the first radio member is a monopole antenna.

6. The wireless communication device as claimed in claim 1, further comprising a connecting member electrically connected to the grounding member and the second section of the second radio member.

7. The wireless communication device as claimed in claim 1, wherein the grounding member is a copper layer plated on a top surface of the base board.

8. An antenna assembly, comprising:

a base board comprising a first side surface and a second side surface perpendicular to the first side surface;

a grounding member secured on the base board and grounding the antenna assembly;

a first radio member electrically connected to the base board to receive and transmit wireless signals having a first central frequency, the first radio member comprising a first portion and a second portion connected and coplanar with the first portion, the first portion perpendicular to the first side surface, the second portion extending parallel along the first side surface; and a second radio member forming a portion of a housing of a wireless communication device and electrically connected to the grounding member, the second radio member coupling with the first radio member to receive and transmit wireless signals having a second central frequency, the second radio member comprising a first section and a second section connecting with the first section, the first section parallel to the first side wall and spaced from the second portion, the second section parallel to and spaced from the second side surface.

9. The antenna assembly as claimed in claim 8, wherein the second radio member is a metal sheet partially wrapping the housing.

10. The antenna assembly as claimed in claim 8, wherein the second radio member is a metal member inlayed in the housing.

11. A wireless communication device, comprising:

a housing; and an antenna assembly received in the housing, the antenna assembly comprising:

a base board comprising a first side surface and a second side surface perpendicular to the first side surface;

a grounding member secured on the base board and grounding the antenna assembly; and a first radio member electrically connected to the base board to receive and transmit wireless signals having a first central frequency, the first radio member comprising a first portion and a second portion connected and coplanar with the first portion, the first portion perpendicular to the first side surface, the second portion extending parallel along the first side surface;

wherein the housing comprises a metal portion electrically connected to the grounding member, the metal portion couples with the first radio member to receive and transmit wireless signals having a second central frequency, the second radio member comprising a first section and a second section connecting with the first section, the first section parallel to the first side wall and spaced from the second portion, the second section parallel to and spaced from the second side surface.

12. The wireless communication device as claimed in claim 11, wherein the metal portion is a metal sheet partially wrapping the housing.

13. The wireless communication device as claimed in claim 11, wherein the metal portion is a metal member inlayed in the housing.

* * * * *